United States Patent [19]

Owen

[11] Patent Number: 4,892,249

[45] Date of Patent: Jan. 9, 1990

[54] RAILROAD GRADE CROSSING WITH IMPROVED TRANSVERSE SPLINE AND ANCHORING ASSEMBLY

[75] Inventor: S. Hudson Owen, Marshfield, Wis.

[73] Assignee: Koppers Industries, Inc., Pittsburgh, Pa.

[21] Appl. No.: 170,527

[22] Filed: Mar. 21, 1988

Related U.S. Application Data

[63] Continuation-in-part of Ser. No. 863,416, May 15, 1986, Pat. No. 4,732,320.

[51] Int. Cl.[4] ..... E01B 21/04

[52] U.S. Cl. ..... 238/8; 404/40

[58] Field of Search ..... 238/2, 6–9; 404/40, 43, 46

[56] References Cited

U.S. PATENT DOCUMENTS

| | | | |
|---|---|---|---|
| 446,752 | 2/1891 | Jaquet et al. | 404/46 |
| 1,191,561 | 7/1916 | Burns | 238/8 |
| 1,279,062 | 9/1918 | Winter | 238/8 |
| 1,946,448 | 2/1934 | White et al. | 238/8 |
| 4,732,320 | 3/1988 | Owen | 238/8 |

*Primary Examiner*—Robert B. Reeves
*Assistant Examiner*—Scott H. Werny
*Attorney, Agent, or Firm*—Herbert J. Zeh, Jr.; Daniel J. Long

[57] ABSTRACT

A railroad crossing is provided in which transverse and end panels are joined by means of splines fitted into indentations on side surfaces of said panels whereby pairs of panels are joined together with a spline fitting partly into each side or end of adjoining panels; and lateral anchor members for fixing the panels adjacent to said rails, the end panels and the outer field panels whereby the need is obviated for affixing the panels to the ties by means of surface spikes. In one embodiment an anchor is used which has vertical wall sections which project upwardly and have inwardly projecting horizontal lips and a spline retaining plate positioned beneath the lips. The spline rests on and is positioned transversely across said lips, and removable means are provided to fix the spline to the retaining plate.

14 Claims, 7 Drawing Sheets

RAILROAD GRADE CROSSING WITH IMPROVED TRANSVERSE SPLINE AND ANCHORING ASSEMBLY

CROSS REFERENCE TO RELATED INVENTION

This is a continuation-in-part of a copending application Ser. No. 863,416 filed May 15, 1986 now U.S. Pat. No 4,732,320.

BACKGROUND OF THE INVENTION

1. Field of the Invention

This invention relates to railways and in particular to railroad grade crossings.

2. Brief Description of the Prior Art

In a conventional railroad grade crossing, wood deck panels are made to fill the space between the tops of the crossties and the top of the rails. The panels are installed over the ties outside the rails (called the field side) and between the rails (called the gage side). During installation, the wood deck panels are placed on the ties in predetermined locations, lead holes are drilled through the panels into the ties beneath, and drive spikes are driven through the panels into the ties, securing the panels in place. Usually eight drive spikes hold the deck panels in place on the ties against the forces generated by rail and vehicular traffic.

With the passage of time and traffic, the rail bed must be maintained at intervals of one to five years. Maintenance consists of replacing worn track parts, re-ballasting and re-aligning the track. At grade crossings, if the track is to be "maintained through" the crossing, the wood deck panels must be removed, and then replaced when the re-alignment is finished. Because the drive spikes are difficult to remove, the deck panels are often destroyed in the removal process.

Treated wood deck panels will last a long time in service, twenty years not being uncommon. Panels installed with drive spikes may develop adverse wear patterns over the years. Also the drive spikes may become raised above the deck surface causing a potential hazard to vehicle tires.

Since the life of the wood deck, if it is left in place, is substantially longer than the track maintenance cycle, many railroads will maintain the track up to each side of the crossing, but skip the crossing itself until the crossing deck is in such a condition that it must be replaced. Because crossings are short in length compared to the whole track, this minor deferred maintenance practice is tolerated in the interest of economy. However, as trains become heavier and faster, a higher degree of track maintenance is required, and the crossings must be repaired more often.

It is to provide an improved railroad crossing to which this invention is directed.

SUMMARY OF THE INVENTION

It has been discovered that an improved railroad grade crossing can be built by joining the wood deck panels by means of steel splines fitted into slots (splineways) on the end and side surfaces of said panels, whereby pairs of panels are joined together with a spline fitting partly into each end of adjoining panels. The splines are held in place by steel fixtures fastened to the ties with conventional track spikes. Besides eliminating the potential vehicle tire hazard of drive spikes, the grade crossing of this invention has the advantage that it may be easily and rapidly removed during the track maintenance cycle, and then, it may be as easily and rapidly replaced, re-using the same deck panels and hardware. It is this ease and economy of removal and replacement that makes the grade crossing of this invention a substantial improvement over present grade crossings. In one embodiment an anchor is used which has vertical wall sections which project upwardly and have inwardly projecting horizontal lips and a spline retaining plate positioned beneath the lips. The spline rests on and is positioned transversely across the lips, and removable means are provided to fix the spline to the retaining plate.

BRIEF DESCRIPTION OF THE DRAWINGS

The grade crossing of the present invention is further described with reference to the accompanying drawings in which.

DETAILED DESCRIPTION OF THE INVENTION

Figure 1:
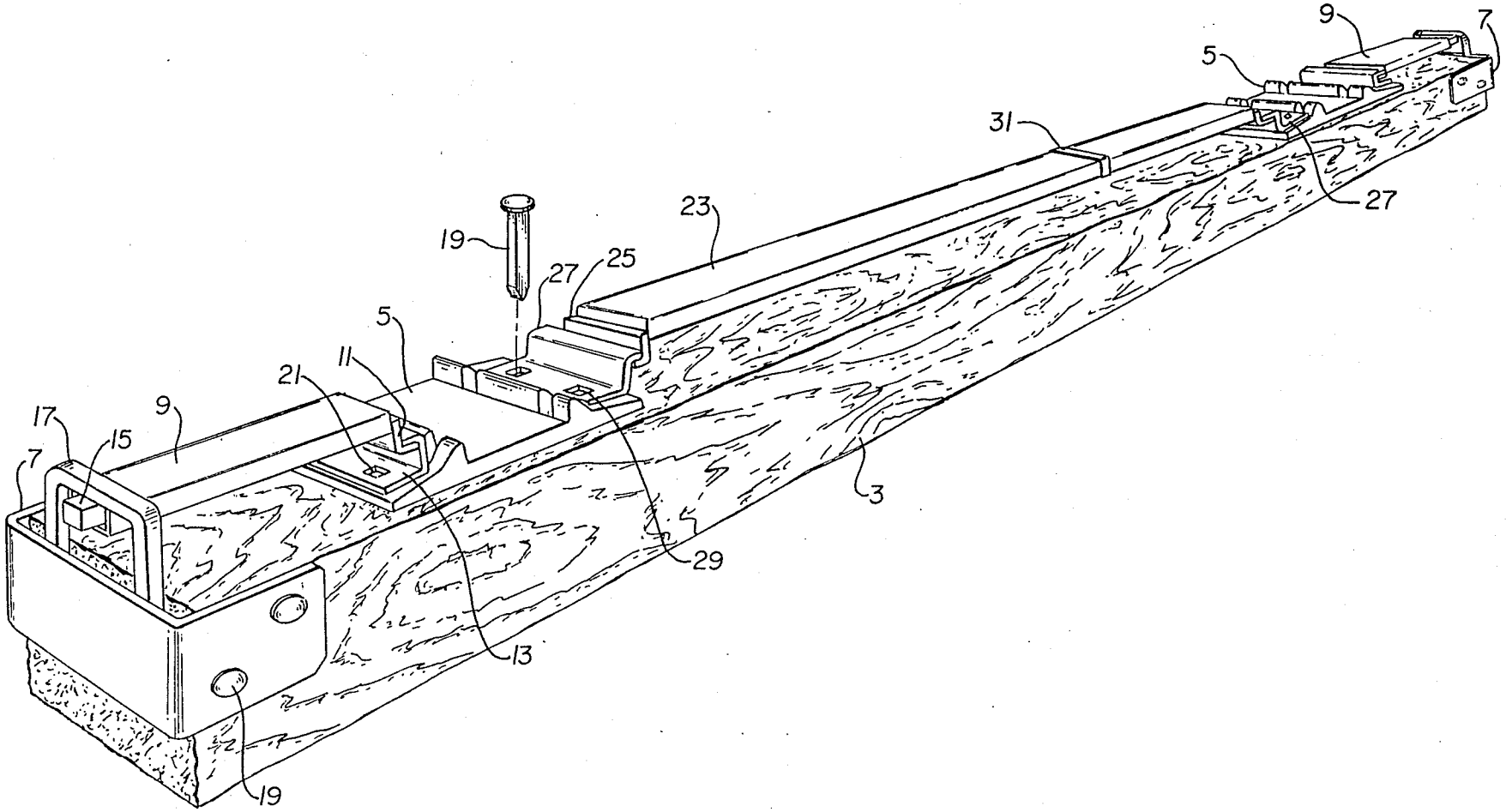
FIG. 1 is an isometric view of an individual crosstie located at the joint between the deck panels showing placement of the joint hardware pieces.
Figure 2:
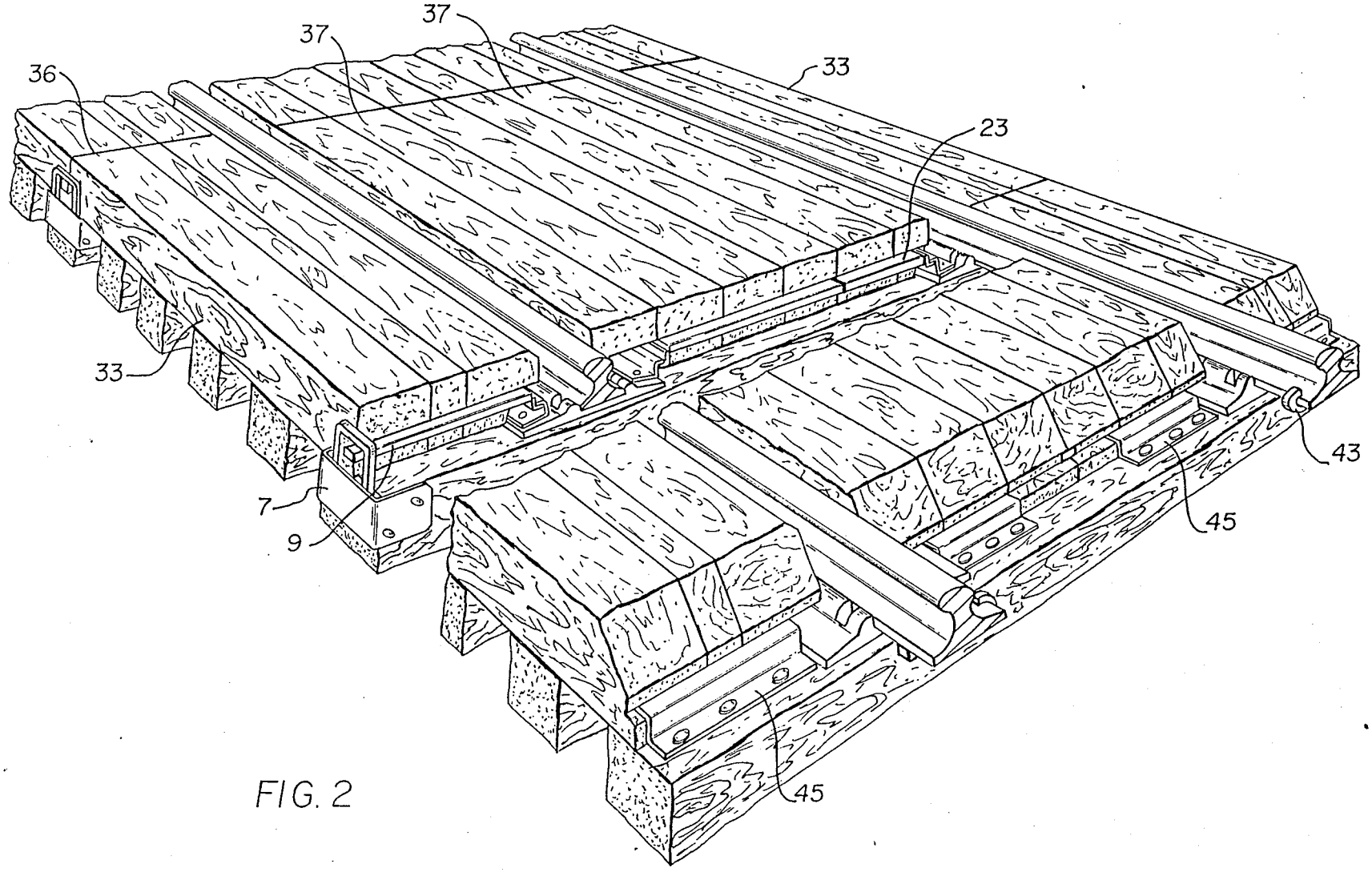
FIG. 2 is an isometric view of the end and center of a grade crossing assembly using straight transverse joints between panels.

Referring now to the FIGS. 1–4, FIG. 1 shows the grade crossing panel connection hardware on crosstie 3 which is not visible from the finished surface when the deck is assembled. Standard eight hole tie plates 5 are used. A field spline retainer 7 is fastened to each end of the tie using track spikes 19, turning the tie on its side during installation of the field spline retainer, and then upright again for installation in the track. A field spline 9 with a hook 11 on one end engages a hook on a field clip 13; and with a tang 15 on the other end engages bail 17 of the field spline retainer. The field clip 13 is fastened to the tie 3 by driving track spikes 19 through holes 21 in the field clip and mating holes in the tie plate 5 into the crosstie 3.

A gage spline 23 with a hook 25 at each end engages the hook of gage clip 27 which gage clip is fastened in place by track spikes 19 driven through holes 29 in the gage clip and mating holes in the tie plate 5 into the crosstie 3. An electrical insulator 31 is installed between the ends of the gage spline 23 to prevent transmission of an electrical signal between rails at controlled crossings.

Figure 4:
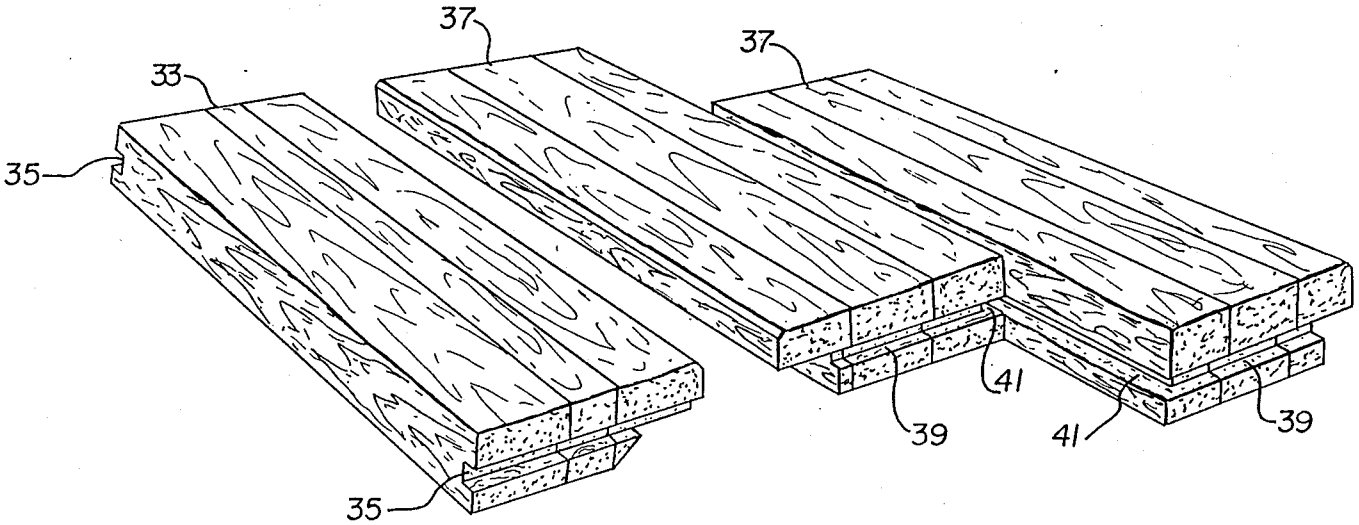
FIG. 4 is an isometric view of the field and gage deck panels showing the splineways milled in each end and longitudinal splineways milled along the length of the gage deck panels.

FIG. 4 illustrates the deck panel splineways. Field deck panel 33 has a splineway 35 milled in each end. Gage deck panel 37 has a splineway 39 milled in each end and has a longitudinal splineway 41 milled on the side of the panel.

The grade rail crossing of this invention is installed in two steps. In the first step, hardware fastened to the crosstie at the panel joints is installed. The field spline retainer 7 (FIG. 1) is fastened to the ends of the ties at the panel joints with track spikes 19. Field clips 13 and gage clips 27 are fastened to the tie with track spikes 19. The track is then ballasted, aligned and tamped in the usual manner if not previously done. Rail anchors 43 (FIG. 3) are installed on each side of each tie located at a panel joint (the ones with hardware on them) and at the deck ends.

Step two is placement and fastening of the deck panels. A field panel 33 (FIG. 2) is placed on the tie ends outside the rail with the panel ends at the center of the joint ties. A field spline 9 is inserted in splineway 35 (FIG. 4) on the end of the field panel 33 (FIG. 3) with the field spline tang 15 (FIG. 1) under the field spline retainer bail 17 and the field spline hook 11 under the hook on the field clip 13. Another field deck panel 33 (FIG. 2) is placed on the tie ends and pried horizontally over the previously installed field spline 9 at joint 36 making a connection between the panels. Another field spline 9 is installed in the free end of the field panel splineway 35 (FIG. 4) and the above procedure repeated until all of the field deck panels are in place. End Z anchors 45 are fastened to the end ties with track spikes 19 securing the field deck panels in place.

Figure 3:
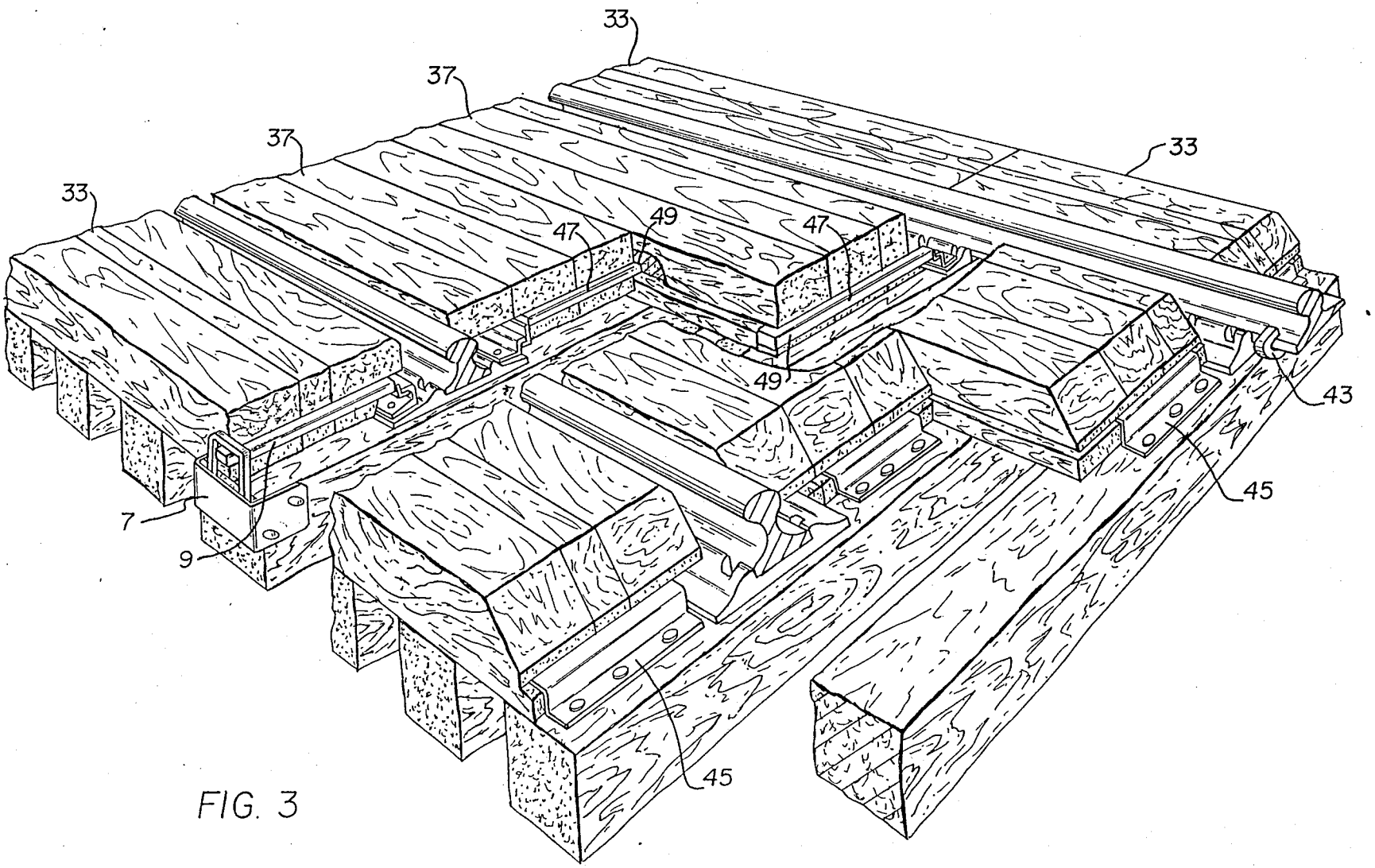
FIG. 3 is an isometric view of the end and center of a grade crossing assembly using staggered transverse joints between panels.

Gage deck panels may be installed with straight joints (FIG. 2) or staggered joints (FIG. 3). In straight joint installation, the gage deck panels 37 are placed on ties between the rails with the panel ends aligned on the joint ties. A gage spline 23 (FIG. 1) is installed in the panels splineway 39 (FIG. 4) with the hook on each end 25 (FIG. 1) underneath the hook on the gage clips 27. Two more gage deck panels 37 (FIG. 2) are then placed on the ties between the rails and pried horizontally over the previously installed gage spline 23 until it is fully engaged in the panels splineway 39 (FIG. 4). Another gage spline 23 (FIG. 2) is installed in the splineway 39 (FIG. 4) at the other end of the gage deck panels as above and the procedure repeated until all of the gage deck panels 37 are in place. End Z anchors 45 (FIG. 2) are fastened to the end ties with track spikes 19 securing the gage deck panels 37 in place.

In staggered joint installation (FIG. 3), gage deck panels 37 are placed on the ties between the rails, but with their ends staggered to align with the previously installed gage clips 27 (FIG. 1). A gage half spline 47 (FIG. 3) with a hook 25 on only one end, is installed in the splineway 39 (FIG. 4) of the near gage deck panel 37 (FIG. 3). The hook 25 (FIG. 1) goes under the hook on the near gage clip 27 (FIG. 1) and the free end of the gage half spline 49 (FIG. 3), which projects beyond the centerline of the track, is engaged in the longitudinal splineway 41 (FIG. 4) of the far gag deck panel 37.

Another gage deck panel 37 is placed on the near side between the rails and pried horizontally until the splineway 39 (FIG. 4) is engaged with the previously installed gage half spline 47 (FIG. 3). Then a second gage half spline 47 is installed in the splineway 39 of the far gage deck panel 37 with the hook 25 (FIG. 1) under the hook of the far gage clip 27 (FIG. 1) and the free end of the gage half spline 49 (FIG. 3) engaged in the longitudinal splineway 41 (FIG. 4) of the near gage deck panel 37.

Another gage deck panel 37 is placed on the far side of the ties between the rails and pried horizontally over the installed far gage half spline 47. Another gage half spline 47 is installed in the splineway 39 (FIG. 4) of the near gage deck panel 37. This alternating procedure is repeated until all of the gage deck panels 37 are in place. End Z anchors 45 are fastened to the end ties with track spikes 19 securing the gage deck panels in place.

In order to remove the deck panels for maintenance or replacement, the end Z anchors 45 are removed by pulling the track spikes 19. Deck panels 33 and 37 are then pried horizontally off splines 9 and 23 and lifted to the side of the track to be reused. The exposed splines 9 and 23 are removed by prying them out of the splineways 35 and 39 and from under the hooks of the field clips 13 and gage clips 27. The next panels are removed as above and the process repeated until all of the deck panels and hardware are at the side of the track.

The field spline retainers 7, field clips 13, and gage clips 27, remain in place for further use.

Following track maintenance, the crossing deck is reinstalled using the above procedure in reverse. By reusing the hardware and the deck panels, considerable time and expense are saved.

Another embodiment of the grade crossing is illustrated in FIGS. 5*a*–12. The spline and anchor assembly by means of which this grade crossing is fixed to existing ties is shown in FIGS. 5*a*–5*f*. The anchor is shown generally in FIG. 5*a* at numeral 48. The anchor has a floor 50, opposed wall sections 52 and 54 and opposed inwardly projecting lips 56 and 58. There are apertures 59, 60, 61 and 62 in the floor through which wood screws 64, 66, 68 and 70 pass. The spline part of the assembly is illustrated in FIG. 5*b* in which the shortened spline segment is shown at numeral 72. This spline is preferably tubular and there are two vertical apertures 74 and 76 through which bolts 78 and 80 pass to engage plate 82 at its threaded receiving apertures 84 and 86. It will be observed that the apertures 74 and 76 are diametrically larger on the upper side of the spline than on the lower side and on the upper side these apertures are larger than the heads of bolts 78 and 80 but smaller than such bolt heads on the lower side. Lock washers 88 and 90 are used in connection, respectively, with bolts 78 and 80. As is shown in FIG. 5*c* the spline is positioned above the lips of the anchor and the plate 82 is positioned below the lips 56 and 58 so that the spline 72 is fixed to the anchor by tightening bolts 78 and 80 in threaded apertures 84 and 86 in plate 82. From FIG. 5*c* it will also be seen that the anchor may be fixed to a wooden tie by means of the wood screws as at 64 and 66. As is explained below, under certain circumstances the spline is additionally secured to prevent longitudinal movement of the entire crossing deck by means of a locking assembly which is shown disassembled in FIG. 5*d* and assembled in FIG. 5*e*. This assembly includes bolts 92 and 94, washers 96 and 98 and perforated plates 100, 102 and 104. The plates may be superimposed on each other and the two perforations in each of those plates may be aligned to allow the bolts to pass through them and engage with the threaded perforations 106 and 108 in plate 104 to form the assembled device shown in FIG. 5*e*. The entire anchor and spline assembly is shown in FIG. 5*f* from which it can be seen that the locking device is attached by positioning the lips 56 and 58 of the anchor between the plates 102 and 104 of the locking assembly and tightening bolts 92 and 94.

Figure 5A:
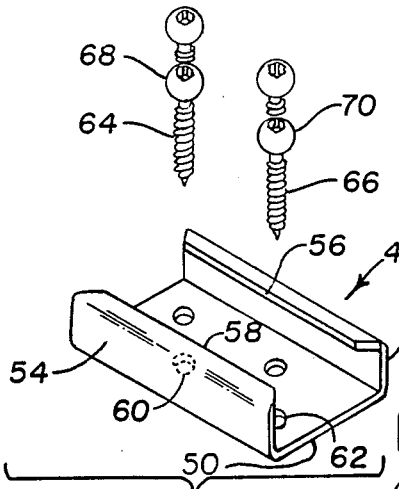
FIGS. 5*a*–5*f* are isometric views of a transverse spline and anchoring system and components thereof of another embodiment of the grade crossing of the present invention.
Figure 5B:
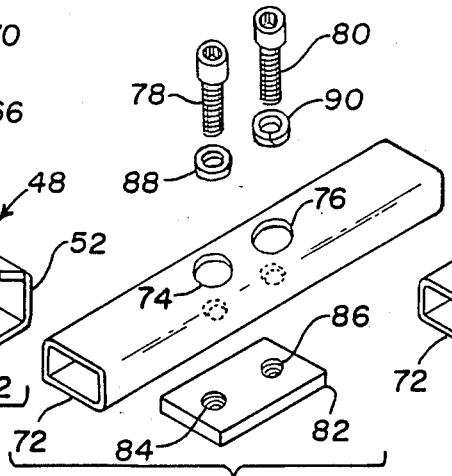
Figure 5C:
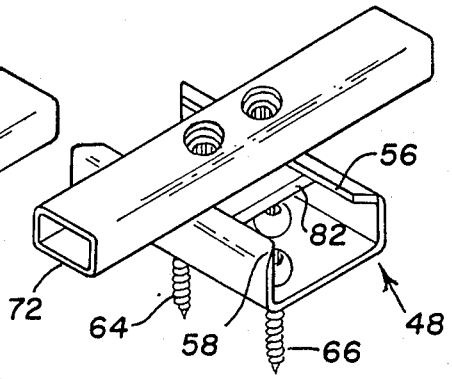
Figure 5D:
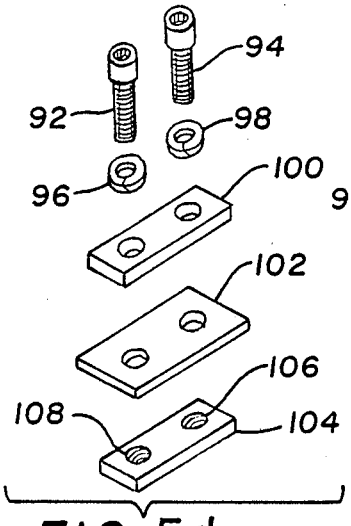
Figure 5E:
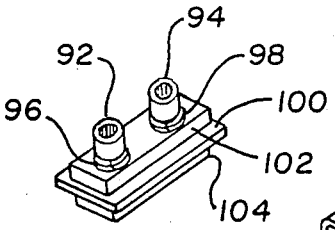
Figure 5F:
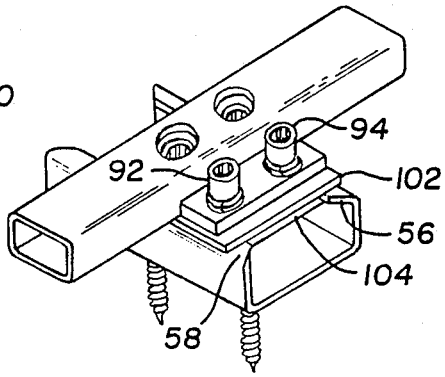
Figure 6:
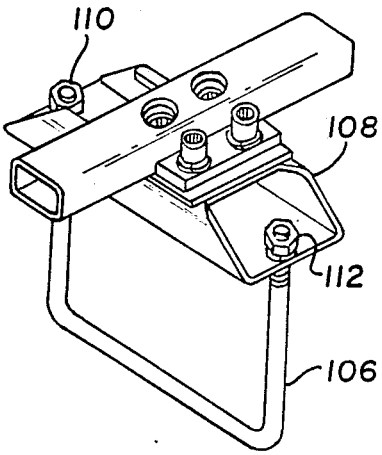
FIGS. 6–8 are isometric views of alternate embodiments of the spline and anchoring system shown in FIGS. 5*a*–5*f*.
Figure 7:
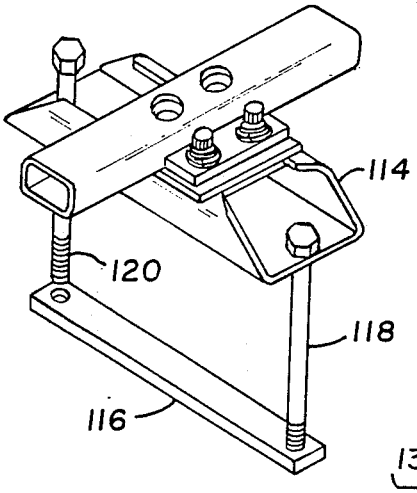
Figure 8:
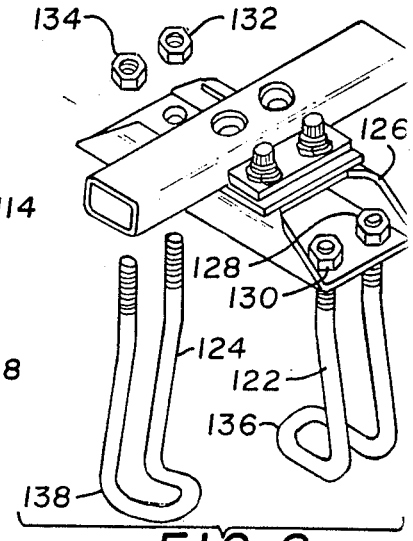
Figure 9:
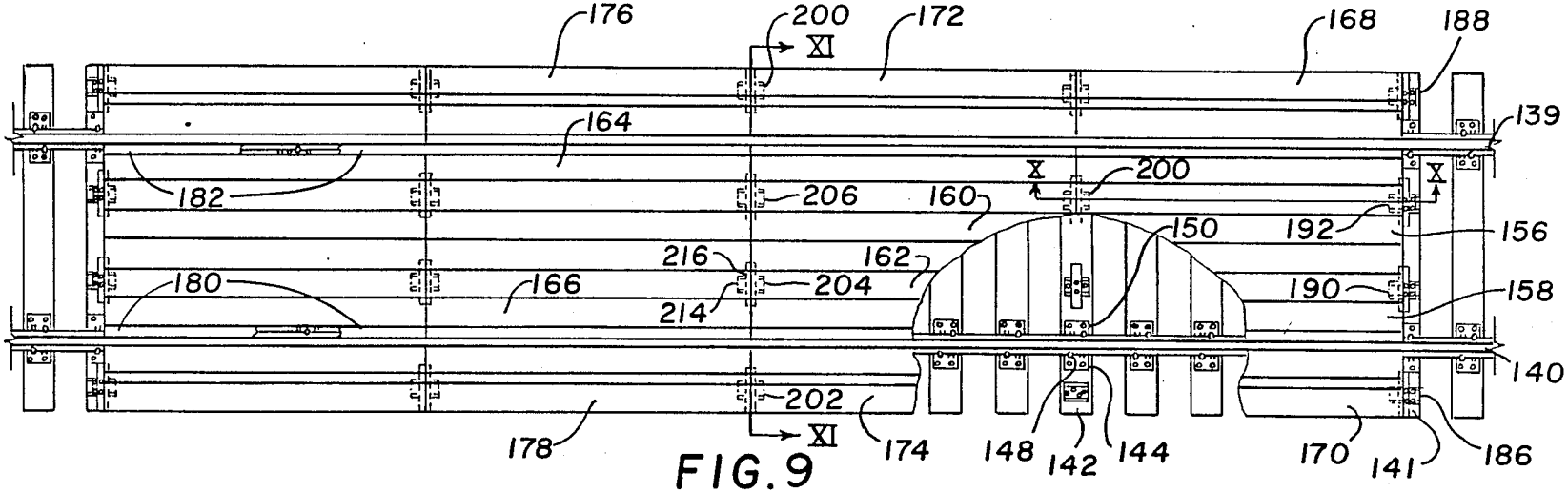
FIG. 9 is a partially cut away plan view of an entire grade crossing in which the transverse spline and anchoring system shown in FIGS. 5*a*–5*f* is used.
Figure 10:
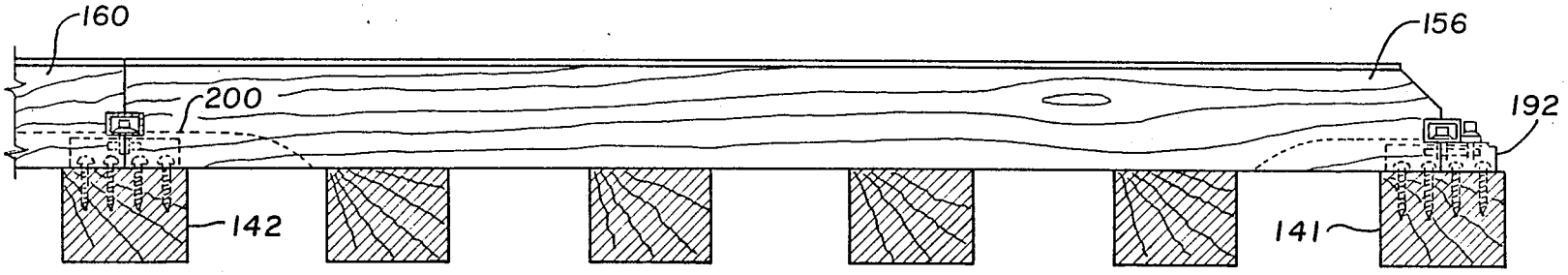
FIG. 10 is an enlarged cross sectional view taken through line X—X in FIG. 9.

Alternative embodiments of this anchor and spline assembly which would be used principally with concrete ties are shown in FIGS. 6–8. In FIG. 6 a U-shaped clamp 106 fits beneath the concrete tie (not shown) and is threaded at its upper end to be engageable with the anchor 108 by means of nuts 110 and 112 to hold the concrete ties between the anchor and the U-shaped clamp. The rest of the assembly is identical to the assembly shown in FIGS. 5*a*–5*f*. In the assembly shown in FIG. 7 the concrete tie (not shown) would be positioned between the anchor 114 and a bar 116 which has threaded perforations adjacent its ends to be engageable with lateral bolts 118 and 120 which can be tightened in said perforations to secure the assembly to the concrete tie. In the partially disengaged assembly shown in FIG. 8 U-J bolts 122 and 124 are fixed to the anchor 126 by means, respectively, of nuts 128 and 130 and nuts 132 and 134. The concrete tie (not shown) would be retained between the anchor and the feet 136 and 138 of the U-J bolts.

Figure 11:
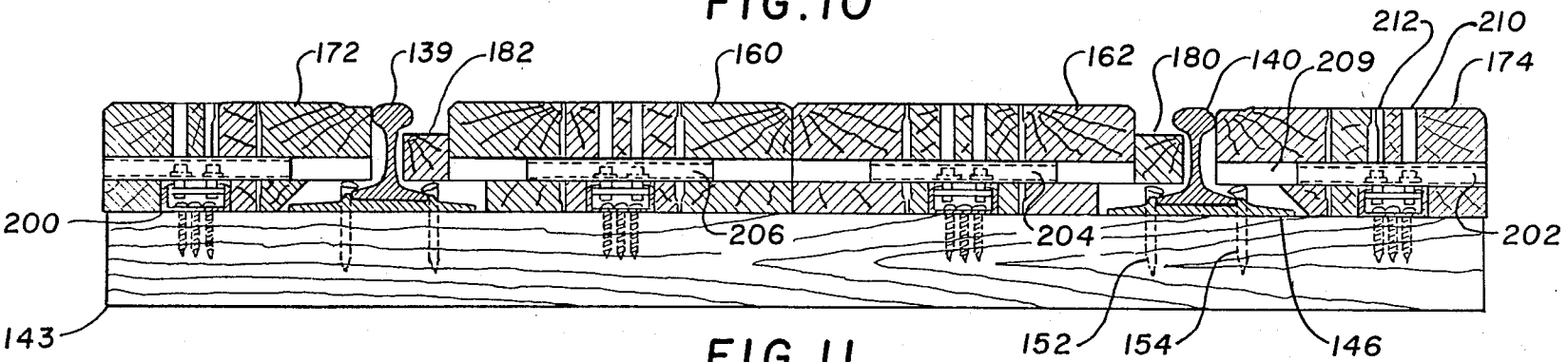
FIG. 11 is an enlarged cross sectional view taken through line X1—X1 of FIG. 9.
Figure 12:
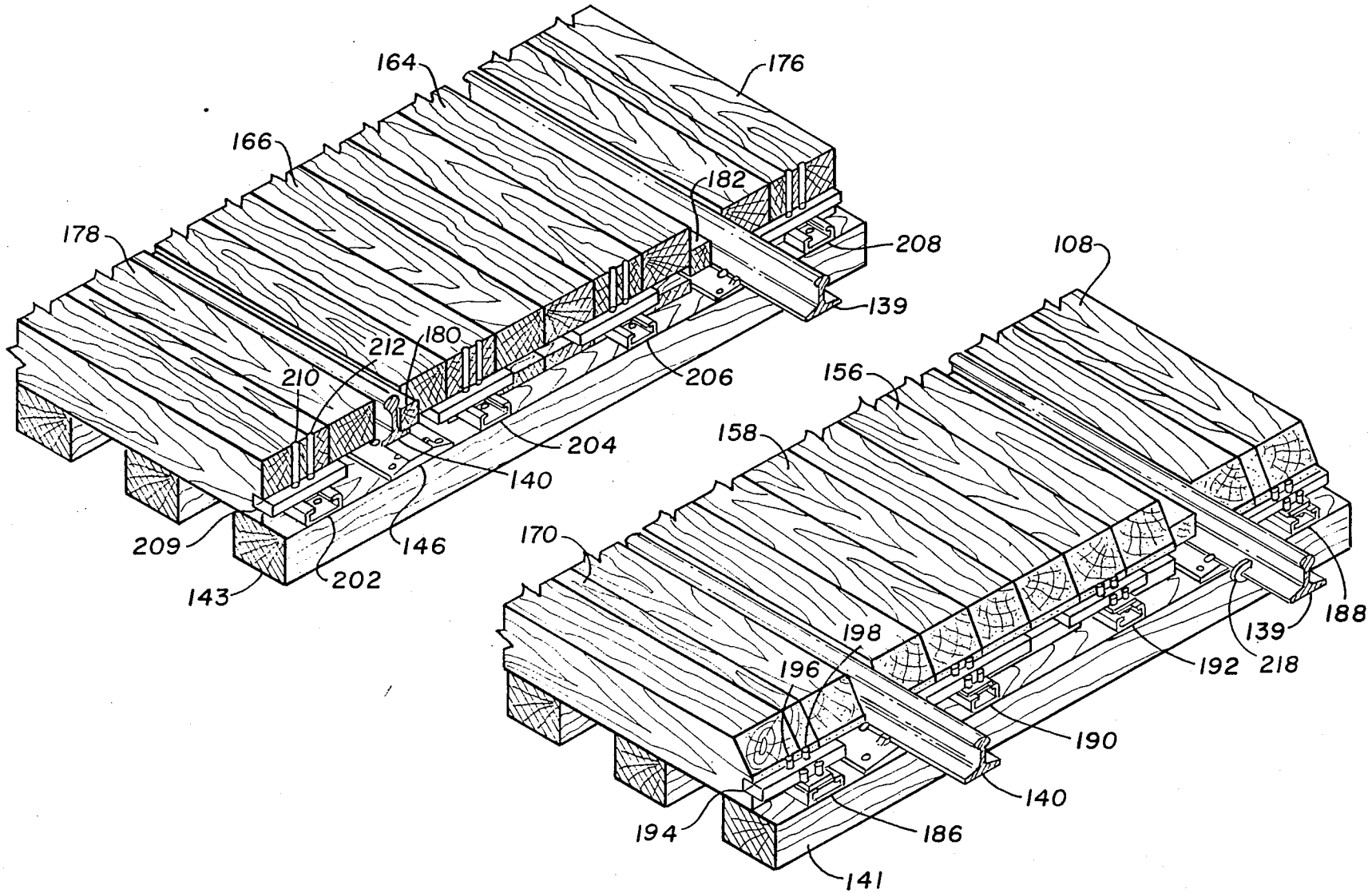
FIG. 12 is a partial isometric view in fragment of the grade crossing shown in FIG. 9.

Another embodiment of the railroad grade crossing of the present invention is shown in FIGS. 9–12. The spline and anchor assemblies described above in connection with FIGS. 5*a*–8 are used with this railroad grade crossing. Referring to FIGS. 9–12, this grade crossing is laid across a railway including rails 139 and 140 and ties as at 141 and 142 (FIG. 9–10) and 143 (FIG. 11–12) which are fastened to said rails by means of tie plates as at 144 (FIG. 9) and 146 (FIG. 11–12) and spikes 148 and 150 (FIG. 9) and 152 and 154 (FIG. 11). This grade crossing is made up of gage panels between the tracks as at 156, 158, 160, 162, 164 and 166 and field panels outside the tracks as at 168, 170, 172, 174, 176 and 178. The gage and field panels are each made up of three juxtaposed timbers held together with dowls. Adjacent both tracks on their inner sides may be a flangeway filler block 180 and 182. At the edges of the grade crossing the field panels 170 and 168 are held to tie 141 in a position outwardly lateral to the rails by anchor and spline assemblies with locking devices 186 and 188, respectively, as are shown above in FIG. 5*f*. These assemblies are positioned in an outer lateral position and are fixed to the tie by wood screws as is described above. The gage panels 158 and 156 are similarly held to tie 141 by anchor and spline assemblies 190 and 192 in an inner lateral position. The assemblies 190 and 192 are also of the type shown in FIG. 5*f*. From FIG. 12 it will be seen that the spline elements of these assemblies fit into horizontal grooves as at 194 in the ends of these panels. It will also be observed that the panels are also indented to accommodate the anchor section of the assembly. Access for the bolts which are used to tighten the spline onto the anchor is provided by means of vertical grooves as at 196 and 198 on the edge of the panels. At places other than at the ends of the crossing, gage and field panels are fixed to the ties and to end to end adjoining panels by means of anchor and spline assemblies such as are shown in FIG. 5*c*. In FIGS. 9–12, such assemblies are shown as at 200. Such assemblies are also shown as at 202 and 208 in an outer lateral position to fix field panels 174 and 178 and 172 and 176, respectively, outwardly adjacent the rails. Such assemblies are also shown as at 204 and 206 in an inner lateral position to fix gage panels 162 and 166 and 160 and 164, respectively, inwardly adjacent the rails. The assemblies would also be fixed to their respective ties by means of wood screws as is described above and a horizontal grove as at 209 (FIGS. 11 and 12) would accommodate the spline segments. The panels positioned over the anchor sections of the assemblies are also indented to accommodate these anchors. Access for the bolts which fix the spline to the anchor as is described above is provided by means of grooves in the edges of the panels as at 210 and 212 (FIGS. 11 and 12). These grooves will match with grooves on the adjoining panel so that there will be bores as at 214 and 216 (FIG. 9) in the assembled grade crossing. A rail anchor as at 218 (FIG. 12) is installed on each side of the tie located at a panel joint and at deck ends. It will also be appreciated that although shortened spline segments are used on each anchor, it would be possible to fix a single segment to two laterally displaced anchors used in emplacing the grade panels. For example, a single spline member could be used to connect the anchors in assemblies 204 and 206.

Although the invention has been described with a certain degree of particularity, it is to be understood that the present disclosure has been made only as an example and that the scope of the invention is defined by what is hereafter claimed.

What is claimed is:

1. A railroad crossing comprising rails supported by ties on a ballast and a deck of gage and outer field panels supported by said ties adjacent to said rails, said panels being substantially level with the top of said rails so as to allow motor vehicle traffic to cross over said rails, the improvement which comprises joining panels by means of transverse splines fitted into indentations on end surfaces of said gage and outer field panels whereby pairs of panels are joined together with one of said splines fitting partly into each end of adjoining panels; and lateral anchor means comprising a floor section fixed to one of said ties and vertical wall sections projecting upwardly from said floor section in transverse relation to on of said splines such that said spline rests on the upper terminal ends of said wall sections and said wall sections having opposed inwardly projecting horizontal lips and a spline retaining plate positioned beneath said lips and fastening means connecting said spline and said spline retaining plate so as to thereby fix the gage panels adjacent to said rails, and outer field panels whereby the need is obviated for affixing the panels to the ties by means of surface spikes.

2. The railroad crossing as recited in claim 1 wherein opposed lateral anchor means are used outwardly adjacent each rail to fix field panels outwardly adjacent to said rails.

3. The railroad crossing as recited in claim 1 wherein opposed lateral anchor means are used inwardly adjacent each rail to fix the gage panels inwardly adjacent to said rails.

4. The railroad crossing as recited in claim 3 wherein opposed lateral anchor means are used inwardly adjacent each rail to fix the field panels inwardly adjacent to said rails.

5. The railroad crossing as recited in claim 4 wherein each anchor means retains a separate spline segment.

6. The railroad crossing as recited in claim 4 wherein the field and grade panels are indented to accommodate the lateral anchor means.

7. The railroad crossing as recited in claim 4 wherein there are aligned vertical apertures in the spline and spline retaining plate through which the fastening means pass.

8. The railroad crossing as recited in claim 7 wherein the fastening means are bolts with heads and the spline is tubular having an upper and lower side and the vertical aperture in the spline is diametrically larger than the bolt head on its top surface and diametrically smaller than the bolt head on its lower side.

9. The railroad crossing as recited in claim 7 wherein there are vertical grooves in the field and grade panels to provide access to the fastening means.

10. The railroad crossing as recited in claim 9 wherein vertical grooves on adjoining field panels are aligned to form bores.

11. The railroad crossing as recited in claim 9 wherein vertical grooves on adjoining grade panels are aligned to form bores.

12. The railroad crossing as recited in claim 4 wherein locking means are fixed to the lateral anchor means positioned at the terminal ends of the crossing to prevent displacement of the spline.

13. The railroad crossing as recited in claim 4 wherein the lateral anchor means are fixed to said ties by means of wood screws.

14. The railroad crossing as recited in claim 4 wherein the lateral anchor means are fixed to said ties by means of clamps.

* * * * *